US007140580B1

(12) United States Patent
Hays

(10) Patent No.: US 7,140,580 B1
(45) Date of Patent: Nov. 28, 2006

(54) IRON HOLDER WITH DRAIN AND RESERVOIR

(76) Inventor: John N. Hays, 3724 Ella Blvd., Houston, TX (US) 77018

( * ) Notice: Subject to any disclaimer, the term of this patent is extended or adjusted under 35 U.S.C. 154(b) by 115 days.

(21) Appl. No.: 10/983,146

(22) Filed: Nov. 4, 2004

(51) Int. Cl.
*D06F 75/40* (2006.01)

(52) U.S. Cl. ..... 248/117.1; D32/142

(58) Field of Classification Search ..... 248/117.1, 248/117.2, 117.3, 117.4, 117.5, 117.6, 117.7, 248/126, 52, 57; D32/73; 38/142
See application file for complete search history.

(56) References Cited

U.S. PATENT DOCUMENTS

| | | | | |
|---|---|---|---|---|
| 2,021,496 | A | 11/1935 | Anger | |
| 2,448,227 | A | 8/1948 | McCan | |
| 2,486,448 | A | 11/1949 | Traxler | |
| 2,493,424 | A | 1/1950 | Stanley | |
| 2,514,400 | A | 7/1950 | Larkins | |
| 2,528,846 | A * | 11/1950 | Sitnick et al. | 248/117.4 |
| 2,529,132 | A | 11/1950 | Burnish, III et al. | |
| 2,530,027 | A * | 11/1950 | Perrigo | 248/117.1 |
| 2,584,011 | A * | 1/1952 | Morris et al. | 248/117.3 |
| 2,603,438 | A | 7/1952 | Adams | |
| 6,116,550 | A * | 9/2000 | Forbes | 248/117.2 |
| 6,550,164 | B1 * | 4/2003 | Rosa | 38/137 |

OTHER PUBLICATIONS

Rubbermaid Home Products—Consumer—Product Catalog, "Ironing Organizer" Model No. 2455-87.

* cited by examiner

*Primary Examiner*—Ramon O Ramirez
(74) *Attorney, Agent, or Firm*—Kenneth A. Roddy

(57) ABSTRACT

An iron holder having an elongate vertical rear wall, an iron support compartment integrally formed with the rear wall intermediate the ends thereof suitable for supporting a steam iron in either of a toe down or a toe up position therein, and a reservoir compartment integrally formed at a lower end of the rear wall and spaced beneath the iron support compartment for collecting water drained from the iron or which may leak from the iron to reduce the formation of mineral deposits in or on the iron.

13 Claims, 5 Drawing Sheets

IRON HOLDER WITH DRAIN AND RESERVOIR

BACKGROUND OF THE INVENTION

1. Field of the Invention

This invention relates generally to holders for irons, and more particularly to an iron holder suitable for storing a steam iron in either a toe down or toe up position having a water drain and a reservoir compartment for collecting water drained from the iron or which may leak from the iron to reduce the formation of mineral deposits in or on the iron.

2. Background Art

Various types of iron holders have been patented and are known in the prior art. However, most of the prior art iron holders are of complex construction, do not allow the placing of an iron into the holder in a toe down position when not in use, and do not have a water reservoir compartment for collecting water drained from the iron or which may leak from the iron to reduce the formation of mineral deposits in or on the iron.

Rubbermaid Home Products, of Fairlawn, Ohio manufactures a commercially available ironing organizer that supports an electric iron in a toe up position and has a cord storage compartment at a lower end thereof for storing the electrical cord, and a removable ironing board support bracket accessory for suspending a folded ironing board. There is no provision for draining the iron.

Larkins, U.S. Pat. No. 2,514,400 discloses an iron holder similar to the Rubbermaid ironing organizer that supports an electric iron in a toe up position and has a cord storage compartment at a lower end thereof for storing the electrical cord. There is no provision for draining a steam iron.

The following patents disclose iron holders of various construction having lateral side flanges or lateral side members that support an iron in a toe down position: Anger, U.S. Pat. No. 2,021,496; McCan, U.S. Pat. No. 2,448,227; Traxler, U.S. Pat. No. 2,486,448; Stanley, U.S. Pat. No. 2,493,424; Burnis III et al, U.S. Pat. No. 2,529,132; Adams, U.S. Pat. No. 2,603,438; and Morozzo et al, U.S. Pat. No. 3,315,928. None of these patents have a provision for draining a steam iron.

The present invention is distinguished over the prior art in general, and these patents in particular by a steam iron holder having an elongate vertical rear wall, an iron support compartment integrally formed with the rear wall intermediate the ends thereof for supporting a steam iron in either of a toe down or a toe up position therein, and a reservoir compartment integrally formed at a lower end of the rear wall and spaced beneath the iron support compartment for collecting water drained from the iron or which may leak from the iron to reduce the formation of mineral deposits in or on the iron.

SUMMARY OF THE INVENTION

It is therefore an object of the present invention to provide an iron holder having an iron support compartment suitable for supporting a steam iron, and a reservoir compartment beneath the iron support compartment for collecting water drained from the iron or which may leak from the iron to reduce the formation of mineral deposits in or on the iron.

It is another object of this invention to provide a steam iron holder having an iron support compartment that supports a steam iron in either of a toe down or a toe up position therein.

Another object of this invention is to provide an iron holder having an iron support compartment that supports an iron in a conveniently accessible safe position when not in use.

A further object of this invention is to provide an iron holder having an iron support compartment that supports an iron and a removable ironing board bracket that supports and conveniently stores a folded ironing board when not in use.

A still further object of this invention is to provide an iron holder having an iron support compartment that is simple in construction, inexpensive to manufacture, and is rugged and reliable in use.

Other objects of the invention will become apparent from time to time throughout the specification and claims as hereinafter related.

The above noted objects and other objects of the invention are accomplished by an iron holder having an elongate vertical rear wall, an iron support compartment integrally formed with the rear wall intermediate the ends thereof suitable for supporting a steam iron in either of a toe down or a toe up position therein, and a reservoir compartment integrally formed at a lower end of the rear wall and spaced beneath the iron support compartment for collecting water drained from the iron or which may leak from the iron to reduce the formation of mineral deposits in or on the iron.

DESCRIPTION OF THE PREFERRED EMBODIMENT

Figure 2:
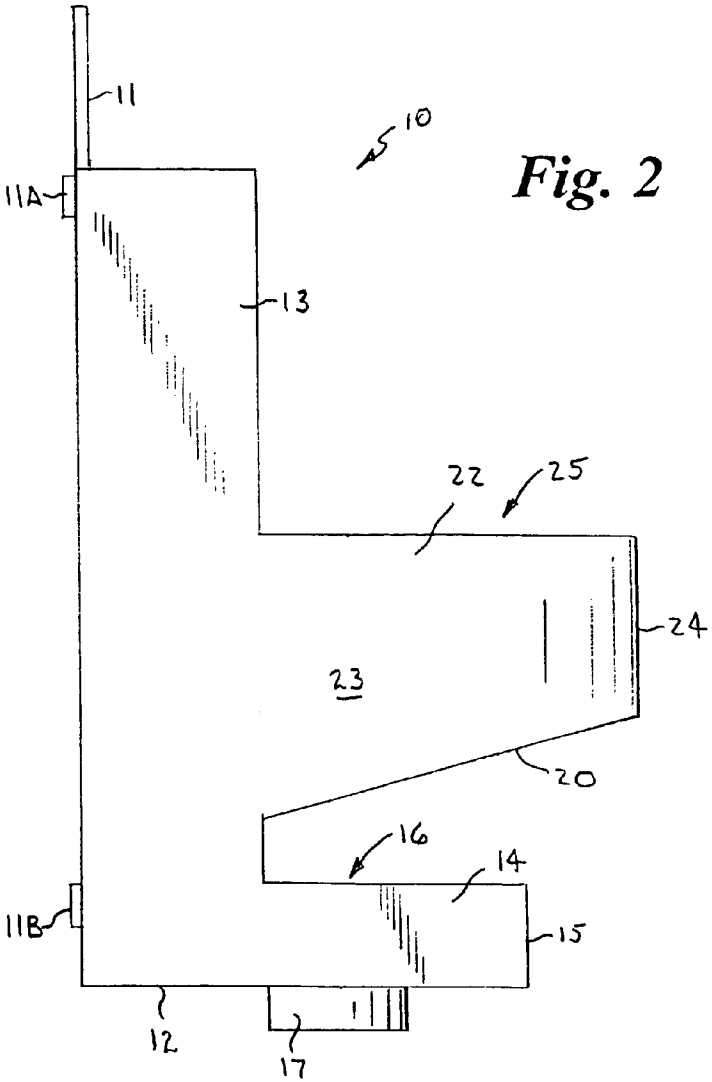
FIG. 2 is a side elevation of the iron holder.
Figure 1:
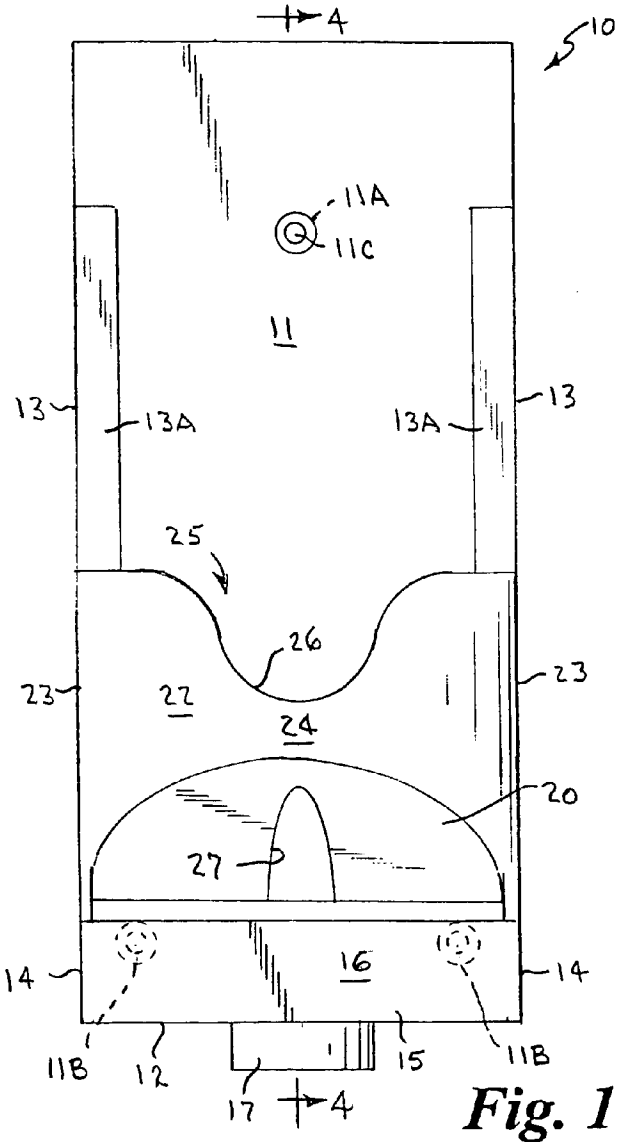
FIG. 1 is front elevation view of the iron holder in accordance with the present invention.
Figure 3:
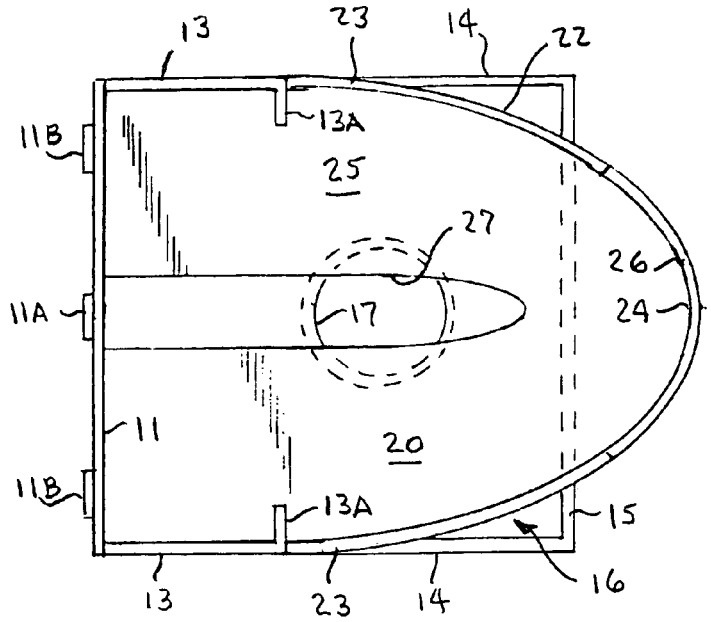
FIG. 3 is a top plan view of the iron holder.

Referring to FIGS. 1–6 of the drawings by numerals of reference, there is shown a preferred iron holder 10. The iron holder 10 is preferably formed of heat resistant thermoset plastic and has an elongate vertical rear wall 11 and a generally square or rectangular bottom wall 12 extending a distance horizontally outwardly from the bottom end thereof.

A pair of elongate laterally spaced parallel side walls 13 integrally formed with the rear wall 11 and bottom wall 12 extend vertically upward from the lateral sides of the bottom wall and terminate a short distance from the top end of the rear wall. A pair of laterally spaced lower side walls 14 extend forwardly from the lower portion of the elongate side walls 13 and vertically upward a short distance along the lateral sides of the bottom wall 12 and adjoin a short front wall 15 extending vertically upward from the front edge of the bottom wall to form a generally rectangular reservoir compartment 16 for collecting water, as described hereinafter.

Figure 4:
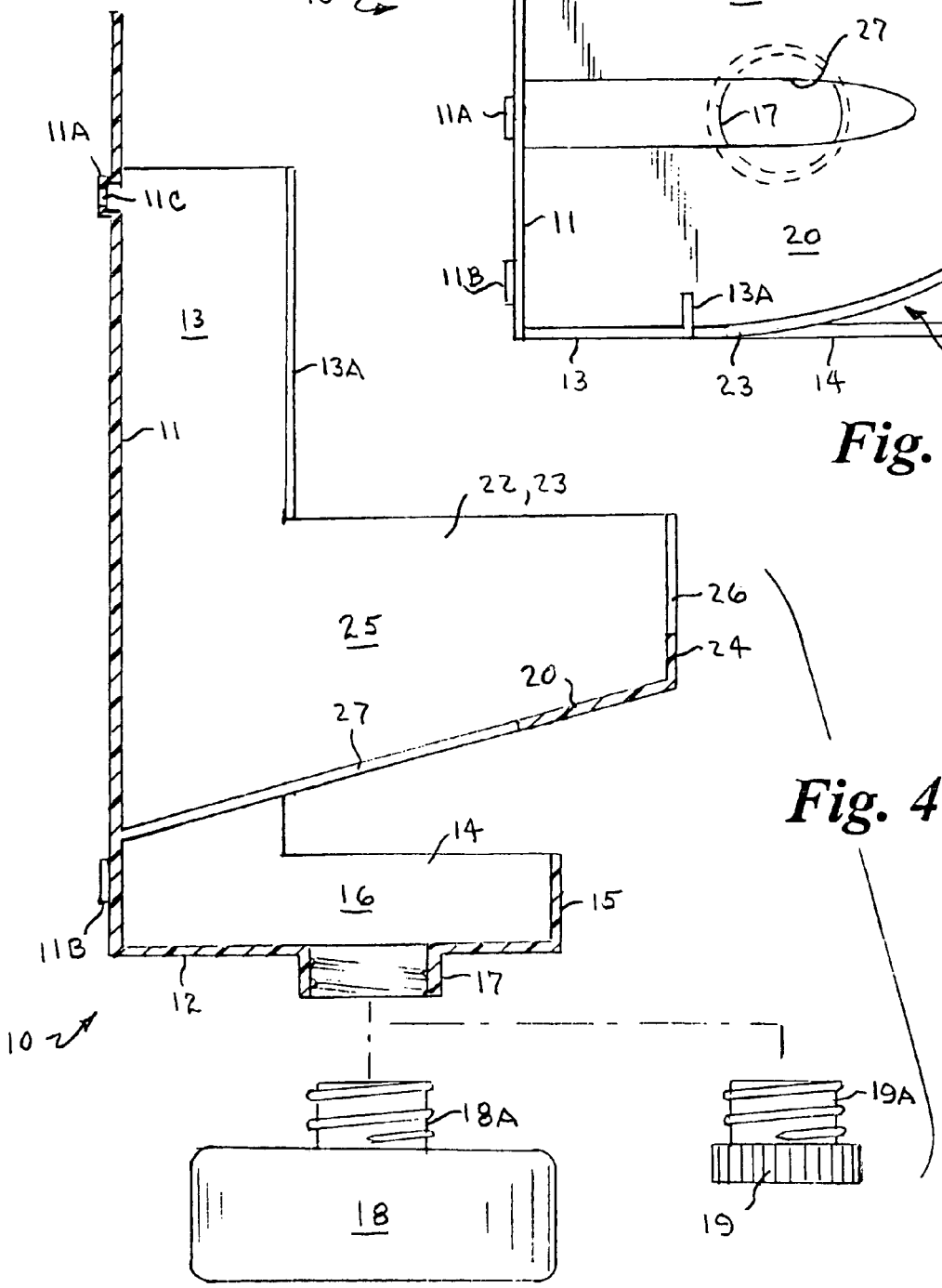
FIG. 4 is a longitudinal cross section view of the iron holder taken along line 4—4 of FIG. 1, showing a water container and a drain plug beneath the reservoir drain.

As best seen in FIG. 4, the bottom wall 12 is provided with a central tubular drain outlet 17, which in a preferred embodiment, is internally threaded for threaded engagement with either the threaded neck portion 18A of a small container 18 or the threaded shank 19A of a drain plug 19.

An inclined intermediate wall 20 extends angularly outward and upward from the rear wall 11 a short distance above the reservoir compartment 16 and has a convex curved front end portion. A side wall 22 having laterally spaced side portions 23 and a curved front portion 24 extends forwardly from the intermediate portion of the elongate side walls 13 and vertically upward along the lateral sides and curved front portion of the inclined intermediate wall 20 to form a support compartment 25 for supporting an iron, as described hereinafter. The curved front end portion 24 of the side wall 22 is provided with a curved recess 26 extending a distance downwardly from its top end to accommodate the handle or control knobs of the iron. The inclined intermediate wall 20 has an elongate central slot 27 that extends from its juncture with the rear wall 11 and terminates a short distance from its front end. As seen in FIG. 4, the central slot 27 is disposed a distance above the drain outlet 17 in the bottom wall 12.

The forward edges of the elongate laterally spaced parallel side walls 13 above the laterally spaced side portions 23 of the side wall 22 of the support compartment 25 are turned inwardly toward each other to provide a pair of bearing or retainer lips or flanges 13A that are preferably spaced parallel to the rear wall 11.

The rear wall 11 is provided with a small circular upper protrusion 11A near its upper end and a pair of laterally spaced lower protrusions 11B near its lower end that protrude a short distance rearwardly from its back surface and each has a hole 11C therethrough for receiving a screw fastener to attach the holder 10 to a supporting structure such as a wall or door.

Figure 5:
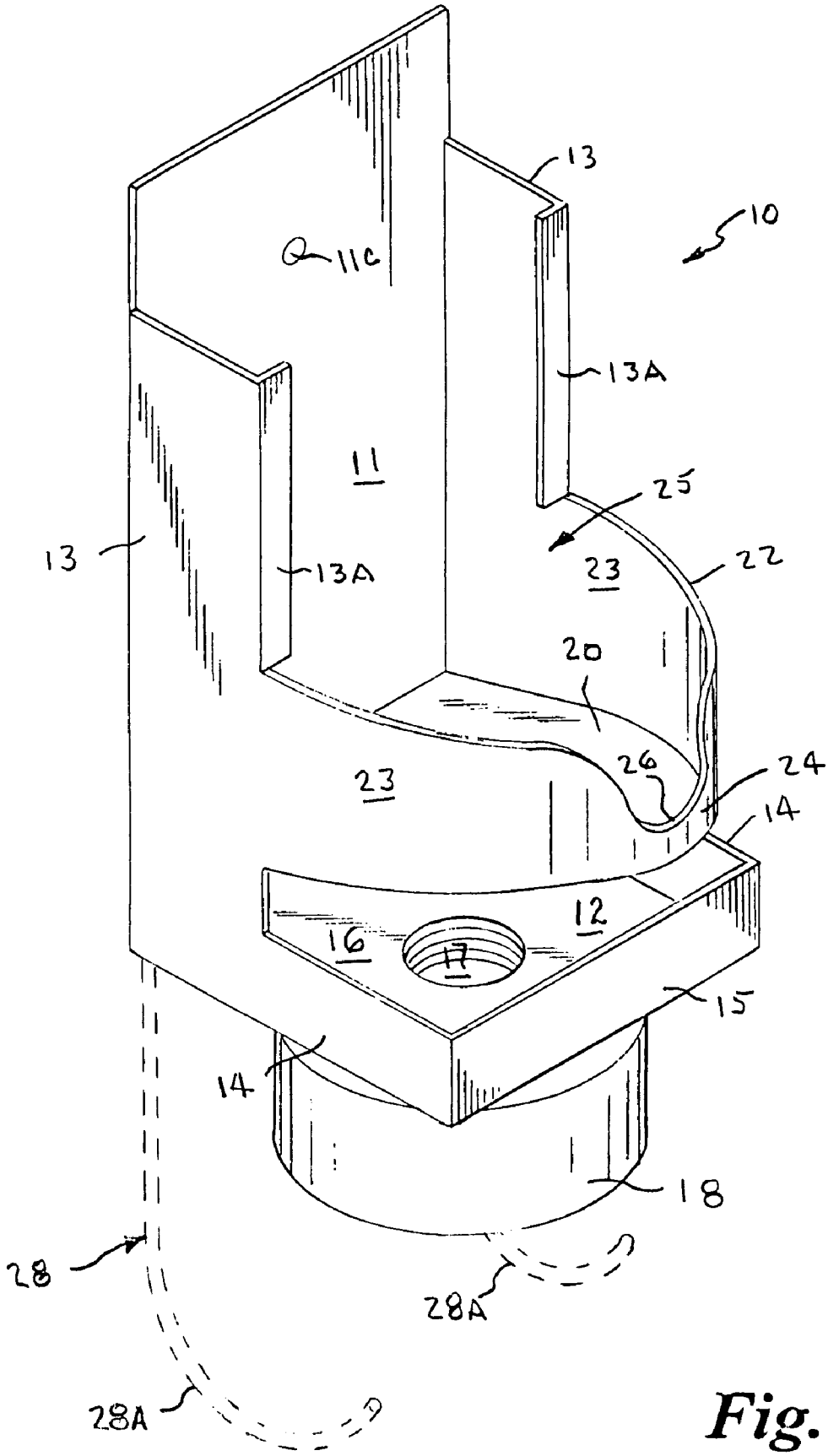
FIG. 5 is a perspective view of the iron holder as seen from the front, showing an ironing board support bracket in dashed line.
Figure 6:
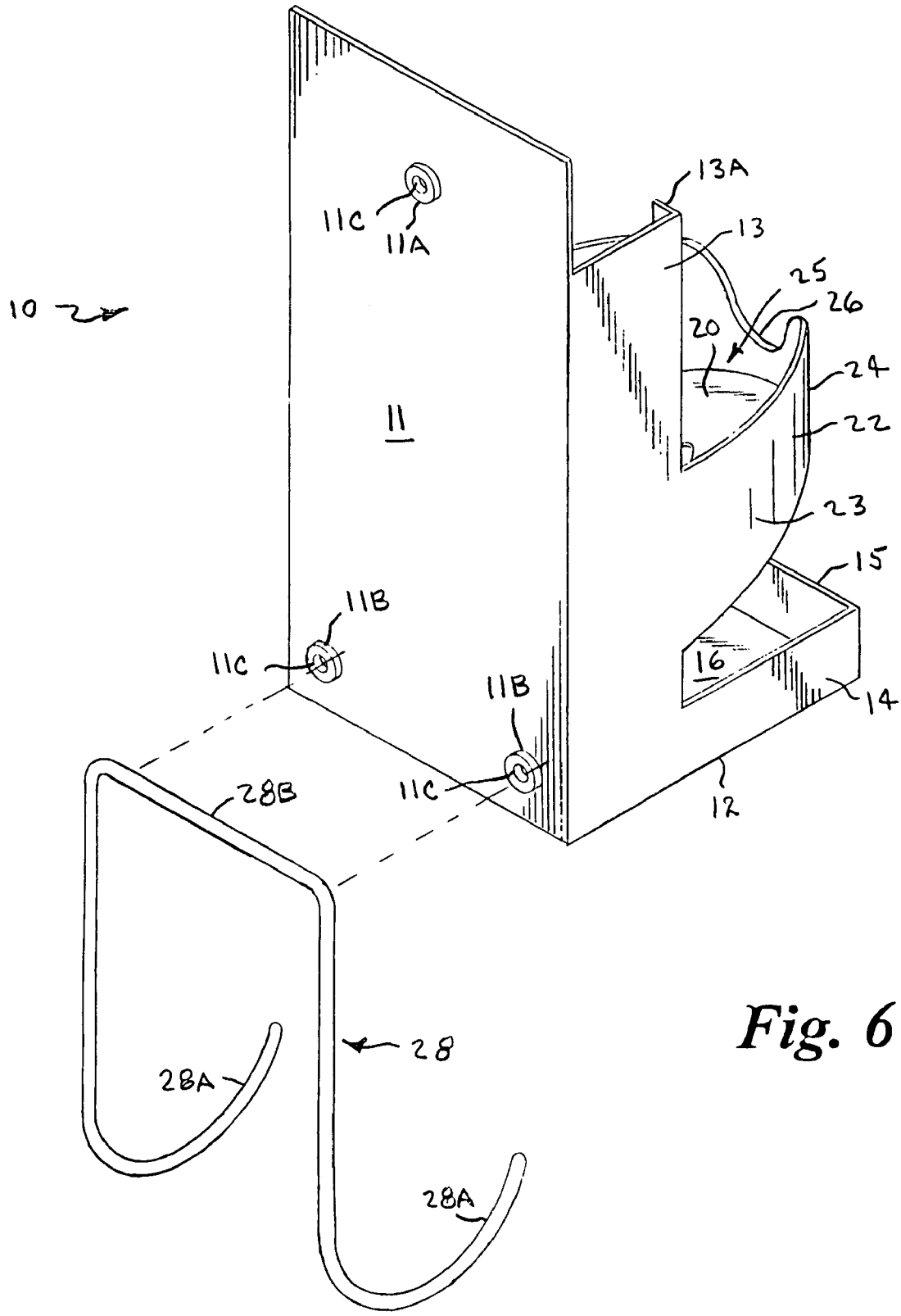
FIG. 6 is a perspective view of the iron holder as seen from the back, illustrating the ironing board support bracket mounting arrangement.

The holder 10 may be furnished with an accessory ironing board support bracket 28 for supporting an ironing board. As shown in FIGS. 5 and 6, a suitable ironing board support bracket 28 is formed of bent wire having a pair of laterally spaced generally J-shaped leg portions 28A adjoined at their upper ends by a straight top portion 28B. The length of the straight top portion 28B and lateral spacing of the J-shaped leg portions 28A are dimensioned such that the corner portions of the straight portion and laterally spaced leg portions may be received and supported on the outer periphery of the laterally spaced lower protrusions 11B on the back surface of the rear wall 11 of the holder 10. The ironing board support bracket 28 is captured between the back surface of the rear wall 11 of the holder 10 and the supporting structure, and a folded ironing board may be suspended therefrom by placing the laterally extending foot portions of the folded ironing board in the J-shaped leg portions 28A of the bracket 28.

In use of the present invention, the threaded neck portion 18A of the small container 18 or the threaded shank 19A of the drain plug 19 may be selectively screwed onto the tubular drain outlet 17 of the reservoir compartment 16, and an electric steam iron 30 is slid downwardly into the support compartment 25 between the elongate vertical side walls 13, and flanges 13A, so that the iron will be supported on the inclined intermediate wall 20 at the bottom thereof with its handle portion 30A or control knobs received in, or adjacent to, the recess 26 of the curved front portion 24 of the support compartment and its sole plate 30B adjacent to the rear wall 11.

Figure 7:
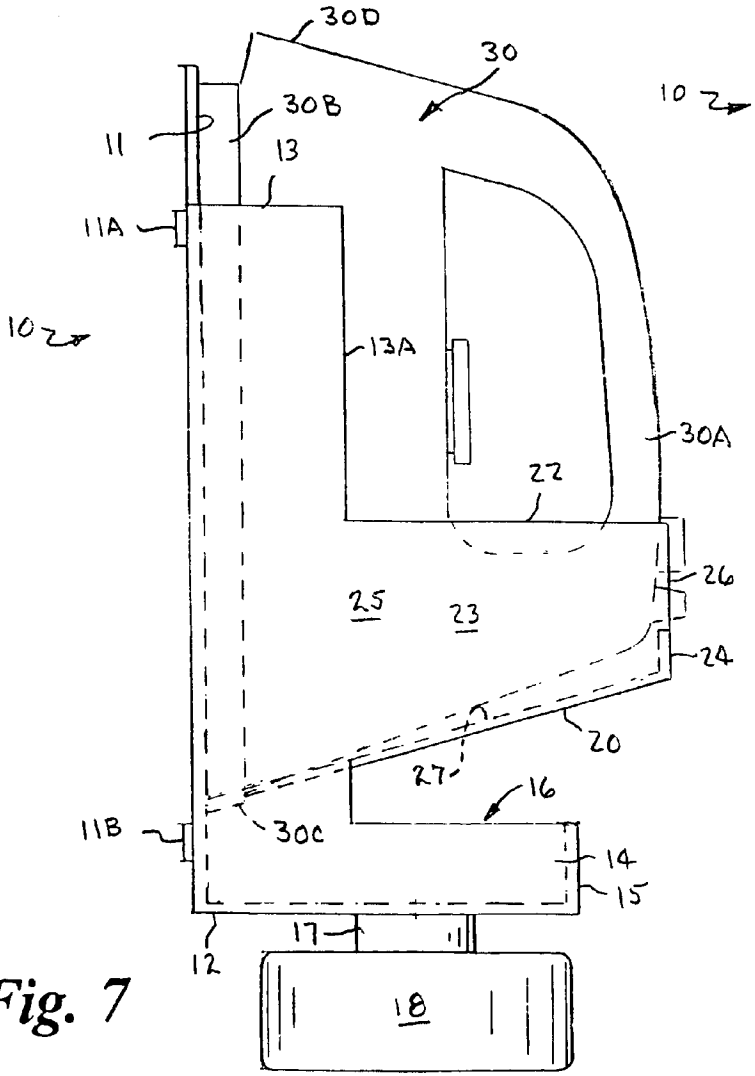
FIG. 7 is a side elevation of the iron holder, showing a steam iron supported therein in a toe down position with the water container installed beneath the reservoir.

As shown in FIG. 7, the iron 30 may be placed into the support compartment 25 with its toe portion 30C supported on the inclined intermediate wall 20, whereby any water leaking or draining from its apertures will run downwardly and along the inclined intermediate wall and pass outwardly through the slot 27 and into the reservoir compartment 16. If the iron is equipped with a valve to allow water to pass outwardly from its interior reservoir, it may be opened to facilitate complete drainage of water from the iron reservoir into the reservoir compartment 16 of the holder, thereby allowing the iron to empty and reducing the formation of mineral deposits on and in the iron. If the small container 18 is installed, the water will pass from the reservoir compartment 16 into the container, which, after the iron has drained, can be unscrewed, and the water disposed of. Otherwise, if the drain plug 19 is installed, the reservoir compartment 16 will hold a predetermined volume of water.

Figure 8:
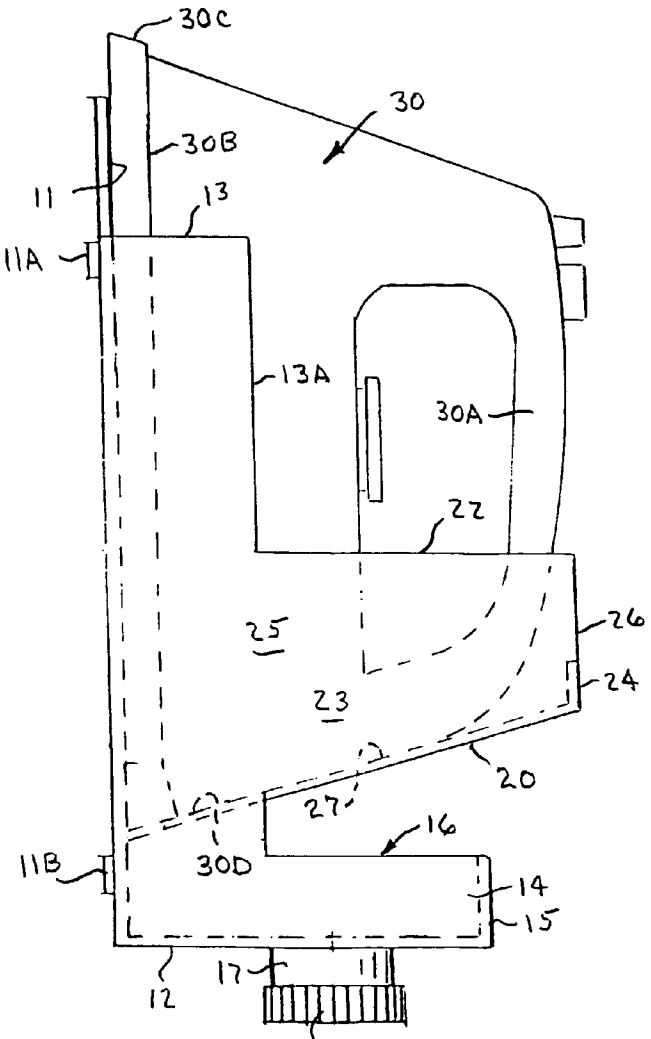
FIG. 8 is a side elevation of the iron holder, showing an iron supported therein in a toe up position with a drain plug installed in the reservoir drain.

As shown in FIG. 8, the iron 30 may also be slid downwardly into the support compartment 25 between the elongate vertical side walls 13, and flanges 13A, so that the heel portion 30D of the iron will be supported on the inclined intermediate wall 20 at the bottom thereof with its handle portion 30A received in the recess 26 of the curved front portion 24 of the support compartment and its sole plate 30B adjacent to the rear wall 11.

While this invention has been described fully and completely with special emphasis upon preferred embodiments, it should be understood that within the scope of the appended claims the invention may be practiced otherwise than as specifically described herein.

I claim:

1. An iron holder for supporting an electric steam iron, comprising:

an elongate vertical rear wall;

an iron support compartment integrally formed with said rear wall intermediate the ends thereof for supporting a steam iron in either of a toe down or a toe up position therein; and a reservoir compartment integrally formed at a lower end of said rear wall and spaced beneath said iron support compartment for collecting water drained from the iron or which may leak from the iron to reduce the formation of mineral deposits in or on the iron.

2. The iron holder according to claim 1, further comprising:

an aperture in said iron support compartment configured to channel water that may leak or drain from the iron into said reservoir compartment.

3. The iron holder according to claim 1, further comprising:

a drain outlet in communication with said reservoir compartment adapted to removably engage a container;

a container adapted to be removably engaged with said drain outlet to allow water to flow therein from said reservoir compartment.

4. The iron holder according to claim 1, wherein said reservoir compartment comprises a generally rectangular compartment having a bottom wall and a pair of parallel laterally spaced vertical side walls extending a distance forward from a lower end of said rear wall and a vertical front wall adjoined thereto.

5. The iron holder according to claim 1, wherein said iron support compartment comprises a bottom wall having a curved front portion and a vertical side wall having laterally spaced side portions extending a distance forward from said rear wall and a contiguous convex curved front portion adjoined to said bottom wall; and a pair of parallel laterally spaced elongate side walls integrally formed with said rear wall extending forward from lateral sides thereof and vertically upward from said lateral side portions of said support compartment side wall and terminating a short distance from a top end of said rear wall;

said elongate side walls having inward turned lip portions extending vertically along forward ends thereof facing in laterally opposed relation.

6. The iron holder according to claim 5, wherein said iron support compartment bottom wall extends angularly forward and upward from said rear wall.

7. The iron holder according to claim 1, wherein said contiguous convex curved front portion of said iron support compartment vertical side wall has a recess extending at an upper end configured to accommodate a handle portion or control knobs of an iron supported in said iron support compartment.

8. The iron holder according to claim 1, further comprising:

a small circular upper protrusion near at an upper end of said rear wall and a pair of laterally spaced lower protrusions at a lower end thereof that protrude a short distance rearwardly from a back surface thereof, each having a hole therethrough for receiving a fastener to attach said holder to a supporting structure.

9. The iron holder according to claim 8, further comprising:

an ironing board support bracket accessory having a pair of laterally spaced generally J-shaped leg portions adjoined at upper ends by a straight top portion;

said straight top portion and said J-shaped leg portions configured to be removably received and supported on outer peripheral portions of said laterally spaced lower protrusions, whereby said ironing board support bracket is captured between said back surface of said rear wall and the supporting structure when said holder is attached thereto and said J-shaped leg portions are disposed a distance beneath said reservoir compartment to receive laterally extending foot portions of a folded ironing board.

10. The iron holder according to claim 1, further comprising:

a drain outlet in communication with said reservoir compartment adapted to removably engage a drain plug; and a drain plug adapted to be removably engaged with said drain outlet to close said drain outlet and maintain water in said reservoir compartment.

11. A method for supporting an electric steam iron to facilitate draining water from the iron and reduce formation of mineral deposits on or in the iron, comprising the steps of:

providing an iron holder having an elongate vertical rear wall, an iron support compartment integrally formed with said rear wall intermediate the ends thereof for supporting a steam iron in a toe down position therein, and a reservoir compartment integrally formed at a lower end of said rear wall and spaced beneath said iron support compartment;

placing said steam iron in said support compartment in a toe down position; and allowing water to drain from the steam iron into said reservoir compartment.

12. The method according to claim 11, comprising the step of:

attaching a removable container to said reservoir compartment, and allowing water to drain from the steam iron into said reservoir compartment, and from said reservoir compartment into said container.

13. The method according to claim 12, comprising the further step of:

removing said container from said reservoir compartment, and disposing of the water collected in said container.

* * * * *